US006217245B1

(12) United States Patent
El-Fakir et al.

(10) Patent No.: US 6,217,245 B1
(45) Date of Patent: Apr. 17, 2001

(54) WRITING INSTRUMENT HAVING A GLITTER EMBEDDED BARREL AND METHOD OF MAKING SAME

(75) Inventors: Linda El-Fakir, Edison; Richard Ginelli, Oakland, both of NJ (US); Benjamin Tao, Tucson, AZ (US)

(73) Assignee: Flying Color Toys, Inc., Dexter, MI (US)

( * ) Notice: Subject to any disclaimer, the term of this patent is extended or adjusted under 35 U.S.C. 154(b) by 0 days.

(21) Appl. No.: 09/505,522

(22) Filed: Feb. 17, 2000

(51) Int. Cl.[7] ..... B43K 29/00
(52) U.S. Cl. ..... 401/195; 401/52; 56/60
(58) Field of Search ..... 401/195, 49, 50, 401/52; 156/736, 60

(56) References Cited

U.S. PATENT DOCUMENTS

| | | | |
|---|---|---|---|
| D. 37,855 | 2/1906 | Faber . | |
| D. 37,869 | 3/1906 | Faber . | |
| D. 37,870 | 3/1906 | Faber . | |
| D. 87,523 | 8/1932 | Kahn . | |
| D. 92,212 | 5/1934 | Sheaffer . | |
| D. 156,633 | 12/1949 | Krause . | |
| 4,840,669 | 6/1989 | Hughes et al. . | |
| 4,859,242 | 8/1989 | Hughes et al. . | |
| 4,990,013 | 2/1991 | Hejmanowski . | |
| 5,261,952 | 11/1993 | Craig . | |
| 5,264,267 | 11/1993 | Wang . | |
| 5,383,954 | 1/1995 | Craig . | |
| 5,431,615 | 7/1995 | Correll . | |
| 5,582,532 | 12/1996 | Tucker . | |
| 5,669,143 | 9/1997 | Wu . | |
| 5,735,622 | 4/1998 | Melnick et al. . | |
| 6,048,422 * | 4/2000 | Kim, II et al. | 156/73.6 |

* cited by examiner

*Primary Examiner*—David J. Walczak
(74) *Attorney, Agent, or Firm*—Helfgott & Karas, P C.

(57) ABSTRACT

A writing instrument is manufactured in a unique manner by the application of three layers of materials which provide an overall partially transparent and iridescent glitter coated pen or pencil configuration. The main body can be of plastic or wood and has a base coat of a relatively dark colorant such as a lacquer paint applied to the barrel of the writing instrument. A layer of wood and plastic adhesive preferably of a resin-type adhesive such as polyvinyl acrylic adhesive is then applied over the base colorant coat and glitter is deposited thereon preferably at a thickness of only one glitter particle. This glitter is preferably relatively small being approximately 0.08 millimeters in particle size and is preferably electrostatically deposited onto the glue or adhesive layer prior to curing thereof. The curing of the adhesive is then achieved by heating of the writing instrument such as passing thereof through an oven which affixes the glitter in position within the adhesive and affixes the adhesive with respect to the barrel of the writing instrument and with respect to the base colorant. A clear cover coat is preferably applied over the glitter-coated barrel to enhance adherence thereof. Preferably the glitter is of an iridescent mylar to provide an overall frosted appearance which is entirely unique.

71 Claims, 2 Drawing Sheets

WRITING INSTRUMENT HAVING A GLITTER EMBEDDED BARREL AND METHOD OF MAKING SAME

BACKGROUND OF THE INVENTION

1. Field of the Invention

The present invention deals with the field of decorative writing instruments and methods for making uniquely decorative surfaces on the barrels thereof. Generally it is advisable that a decoratively coated writing instrument be also functional in that it is capable of easily being gripped and used in the normal manner as any other writing instrument. Many decorative barrel implements or coatings do not provide a functional surface. The present invention is unique in that pencils make with this process provide a very decorative iridescent frosted type appearance and texture while at the same time being completely functional and easily grasped and in fact enhancing the gripping characteristics of the barrel when a user utilizes the writing instrument in the normal manner.

2. Description of the Prior Art

Prior art designs and methods have been disclosed in design and utility patents disclosing various types of coatings on pencil barrels as shown in U.S. Design Pat. No. 37,855 patented Feb. 27, 1906 to E. Faber on a "Pencil"; and U.S. Design Pat. No. 37,869 patented Mar. 6, 1906 to E. Faber on a "Pencil"; and U.S. Design Pat. No. 37,870 patented Mar. 6, 1906 to E. Faber on a "Pencil"; and U.S. Design Pat. No. 87,523 patented Aug. 9, 1932 to D. Kahn and assigned to David Kahn, Inc. on a "Fountain Pen"; and U.S. Design Pat. No. 92,212 patented May 8, 1934 to C. R. Sheaffer and assigned to W. A. Sheaffer Pen Company on a "Fountain Pen Or Similar Article"; and U.S. Design Pat. No. 156,633 patented Dec. 27, 1969 to H. Krause on a "Writing Implement"; and U.S. Pat. No. 4,840,669 patented Jun. 20, 1989 to C. Hughes et al and assigned to Color Quest Inc. on "Water Soluble Coloring Compositions Containing Sparkle Components"; and U.S. Pat. No. 4,859,242 patented Aug. 22, 1989 to C. Hughes et al and assigned to Color Quest Inc. on "Water Soluble Coloring Compositions Containing Sparkle Components"; and U.S. Pat. No. 4,990,013 patented Feb. 5, 1991 to C. Hejmanowski on a "Glitter Crayon"; and U.S. Pat. No. 5,261,952 patented Nov. 16, 1993 to M. Craig and assigned to Binney & Smith Inc. on a "Solid Marking Composition Containing Glitter"; and U.S. Pat. No. 5,264,267 patented Nov. 23, 1993 to P. Wang on a "Utensil With Glittering Handle"; and U.S. Pat. No. 5,383,954 patented Jan. 24, 1995 to M. Craig and assigned to Binney & Smith, Inc. on a "Solid Marking Composition Containing Glitter"; and U.S. Pat. No. 5,431,615 patented Jul. 11, 1995 to C. Correll on a "Hand-Held Fitness Device For Promoting Exercise"; and U.S. Pat. No. 5,582,532 patented Dec. 10, 1996 to S. Tucker on a "Glitter Toy"; and U.S. Pat. No. 5,669,143 patented Sep. 23, 1997 to P. Wu and assigned to Dyna Chain Industrial Co. Ltd. and Sara Rose International Inc. on an "Eating Utensil With Handle Providing A Visual Amusing Effect"; and U.S. Pat. No. 5,735,622 patented Apr. 7, 1998 to N. Melnick et al and assigned to Pentech International Inc. on a "Writing Instrument with A Compressible Friction Coating And Method Of Making".

SUMMARY OF THE INVENTION

The present invention discloses a unique method of the manufacturing of a writing instrument where the instrument ultimately has a glitter coated barrel with a unique frosted appearance. Initially the instrument is provided with a main body preferably defining a wooden barrel extending therearound with a writing tip at one end. The wooden barrel preferably has a diameter of approximately 6.9 millimeters in order to be less than the standard size of such writing instruments by an amount equal to the thickness of the base colorant coat and the layer of adhesive material with deposited glitter after curing in order to provide a final barrel diameter approximately equal to the standard size. In this manner the writing instrument can be handled in the conventional manner and is not overly large in diameter and also allows use with conventional pencil sharpeners which are designed to sharpen pencils of approximately 7.75–7.8 millimeters in diameter.

Initially the wooden barrel has a base coat applied thereto of a colorant which preferably is a lacquer paint. This base colorant is preferably relatively dark and is certainly darker than the final overall desired color such that subsequent coats and including the adhesive will mask a portion of the color. It is necessary that the base colorant be significantly darker than this final desired color.

The layer of adhesive is then applied thereon by brushing or spraying over the base coat of colorants onto the barrel of the writing instrument. This adhesive material preferably comprises a polyvinyl acrylic glue composition which includes materials useful as adhesives for both wood and plastics. Prior to curing of this adhesive layer a glitter is deposited thereon preferably in an electrostatic manner. Such glitter deposition is called electro flocking and is achieved by placing a voltage differential between the dispensed glitter and the pencil itself which tends to attract the glitter into contact with the uncured adhesive layer on the pencil or writing instrument to achieve complete coating thereof preferably of the thickness of approximately one particle.

This glitter so deposited preferably is partially translucent to allow portions of the base colorant to be visible therethrough. The glitter preferably will be of a mylar material and preferably be iridescent. This iridescent mylar glitter provides a frosted appearance of the writing instrument coating when finally cured. A cover coat or fourth coat of preferably translucent or transparent material can be applied over the glitter-coated barrel to enhance adherence. This cover coat can be made with a clear adhesive material or can be a conventional clear lacquer or enamel paint material. Such cover coat is extremely thin and does not significantly affect the dimensions of the barrel.

Preferably the individual glitter particles are of a size approximately 0.08 millimeters but in any case less than 0.1 millimeters. This mylar glitter is preferably at least partially transparent to an extent to allow approximately 35% of the intensity of the base colorant to be visible therethrough after curing of the layer of adhesive in which it is embedded.

The adhesive material is then cured preferably by heating within an oven to affix the glitter and the adhesive material together with respect to the colorant coated barrel of the writing instrument with the base paint layer and the cured glitter covered adhesive layer being of approximately 0.425 to 0.45 millimeters in thickness. In this manner the final writing instrument diameter after curing of the adhesive will be approximately 7.75 to 7.8 millimeters since the base barrel is 6.9 millimeters in diameter.

It is an object of the present invention to provide a writing instrument having a glitter coated barrel wherein the glitter coating is iridescent.

It is an object of the present invention to provide a writing instrument having a glitter coated barrel wherein the glitter coating the writing instrument is formed of mylar.

It is an object of the present invention to provide a writing instrument having a glitter coated barrel wherein a base colorant is painted with a lacquer paint beneath the glitter and the glitter adhesive layer to facilitate partial viewing thereof through the partially translucent glitter.

It is an object of the present invention to provide a writing instrument having a glitter coated barrel wherein an initial writing instrument barrel of 6.9 millimeters becomes a final barrel of 7.75–7.8 millimeters after applying of the first layer of base colorant, the second layer adhesive and the third layer of glitter thereto and curing.

It is an object of the present invention to provide a writing instrument having a glitter coated barrel wherein sharpening with a conventionally sized pencil sharpener is possible.

It is an object of the present invention to provide a writing instrument having a glitter coated barrel wherein the glitter is firmly adhered to the adhesive.

It is an object of the present invention to provide a writing instrument having a glitter coated barrel wherein use with wooden pencil barrels as well as plastic pencil barrels is possible.

It is an object of the present invention to provide a writing instrument having a glitter coated barrel wherein the adhesive layer is completely covered by a layer of glitter one particle thick due to electrostatic depositing of the glitter upon the adhesive layer.

It is an object of the present invention to provide a writing instrument having a glitter coated barrel wherein the adhesive layer is completely covered by a layer of glitter one particle thick due to electro flocking of the glitter upon the adhesive layer.

It is an object of the present invention to provide a writing instrument having a glitter coated barrel wherein the apparatus for making of the writing instrument is inexpensive.

It is an object of the present invention to provide a writing instrument having a glitter coated barrel wherein the apparatus is easily maintained.

It is an object of the present invention to provide a writing instrument having a glitter coated barrel wherein the apparatus has very few moving parts.

It is an object of the present invention to provide a writing instrument having a glitter coated barrel wherein the apparatus uses relatively inexpensive materials to create a unique frosted appearance.

It is an object of the present invention to provide a writing instrument having a glitter coated barrel wherein final coloration is controlled by variations in intensity and color choice of the base colorant of lacquer paint.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
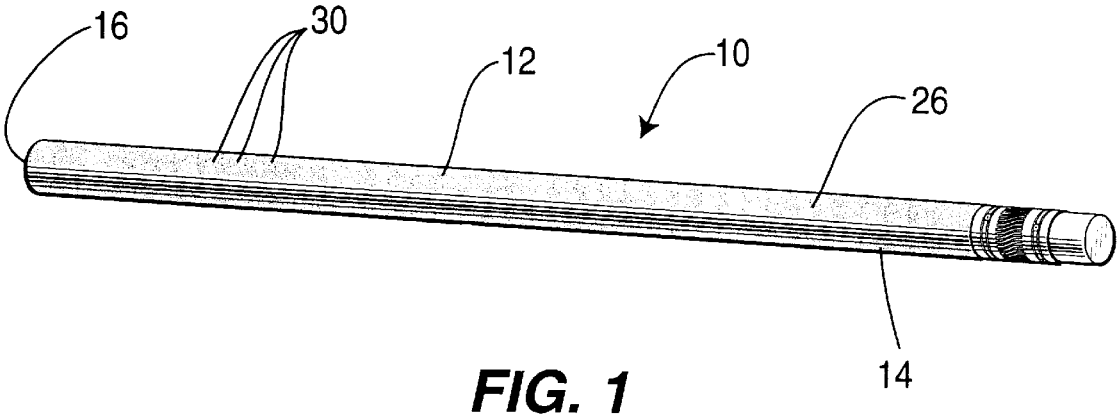
FIG. 1 is a perspective illustration of an embodiment of a writing instrument made according to the method of the present invention.

The present invention provides a unique method for making of a unique writing instrument 10. Such writing instrument includes a conventional main body 12 with a barrel 14 preferably formed of wood. The main body 12 and/or barrel 14 may also be formed from extruded plastic. A writing tip 16 is positioned extending outwardly from the main body 12 to facilitate marking therewith.

The barrel 14 is preferably cylindrically shaped but can be of any shape and includes a first layer 20 of base colorant 22 placed thereon. This base colorant is preferably a paint and more preferably is a paint having a lacquer base. The choice of base color is important because it will partially show through the subsequently deposited layers and has a major impact on the final overall color of the external frosted appearance of the glitter embedded pen of this invention.

Once the base colorant 22 has dried or cured a second layer 24 of adhesive material 26 can be applied thereonto. This second layer 24 can be sprayed or brushed as necessary and will usually extend over the entire surface of the barrel 14 which was coated with the base colorant 22 of the first layer 20. The adhesive material 26 of the second layer 24 preferably comprises a resin based or plastic glue which is used for securing both wood and plastic materials together. As such, the adhesive material 26 can be used for both wood and plastic barrels. Such glue useful in this manner include polyvinyl acrylic adhesive material 26.

The adhesive material 26 needs to be cured. However, prior to curing thereof a third layer of glitter 30 is preferably deposited thereon. Movement of the glitter into contact with the adhesive layer 26 can be difficult sometimes and needs to be done smoothly in order to assure the overall even frosted appearance of the finally formed pencil coating. For this reason the glitter 30 is preferably electrostatically applied to the external surface of the adhesive second layer 24. Such electrostatic flocking is normally performed by placing an electrical potential difference between the writing instrument 10 to be coated and the glitter particles 30 themselves. Such electrostatic deposition is often called electro flocking. In this process often a voltage as high as 10,000 volts is applied to the writing instrument 10 and main body 12 to attract glitter thereto. It is preferable that this glitter be attracted to the adhesive material 26 of the second layer 24 because the glitter needs to cover the entire surface thereof to a depth of preferably one particle. In this manner the full frosted appearance will be achieved while at the same time translucency will be maximized.

A fourth or cover coat 42 can then be applied over the glitter-coated barrel 14 to enhance adherence of glitter 30. The cover coat 42 is of a translucent material or, preferably, a transparent material to allow the coloration of the base colorant 22 and the glitter 30 to shown prominently therethrough. Also this cover coat 42 will be relatively thin such that the overall diameter of the barrel 14 is not significantly increased. Preferably this cover coat 42 is of a clear adhesive material or of a conventional clear coat enamel or lacquer paint material.

It is preferable that the glitter 30 be made of a mylar material and preferably an iridescent mylar and also needs to be at least partially translucent in order to be able to allow viewing of the base colorant 22 therebelow. In the preferred configuration the glitter 30 in the third layer 28 and the adhesive 26 and the second layer 24 will have the effect of obsruring approximately 65% of the intensity of the base colorant 22. In this manner a soft or pastel color will appear through the frosted appearance of the mylar glitter which has been shown to be an extremely attractive and desirable surface configuration.

Figure 2:
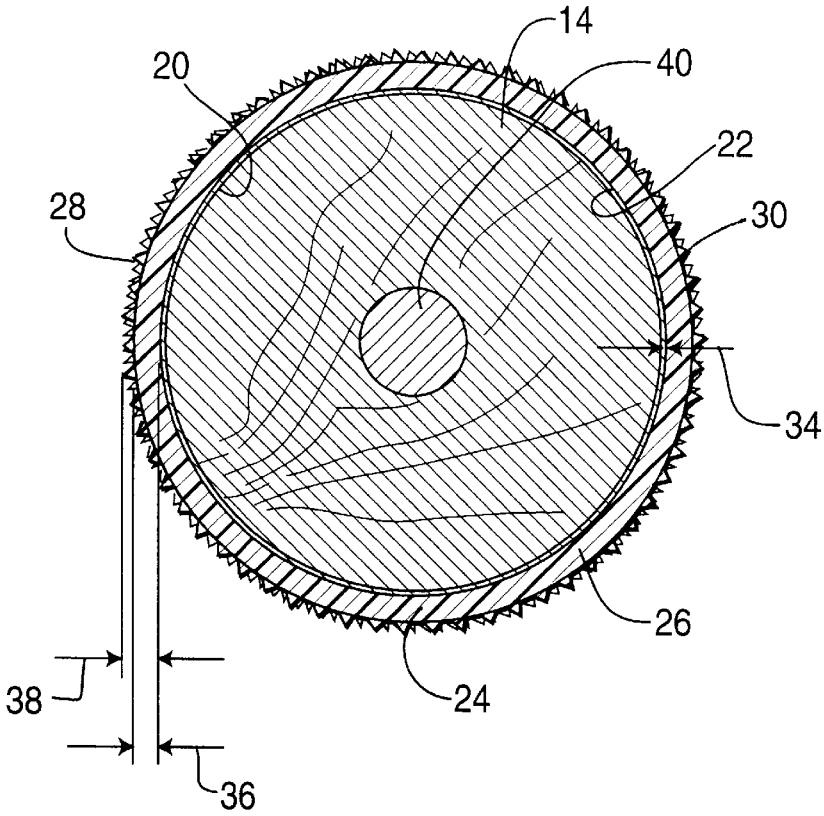
FIG. 2 is a side cross-sectional illustration of the writing instrument shown in FIG. 1 depicting the multiple layers of colorant, adhesive and glitter placed upon a wooden pencil writing instrument.
Figure 3:
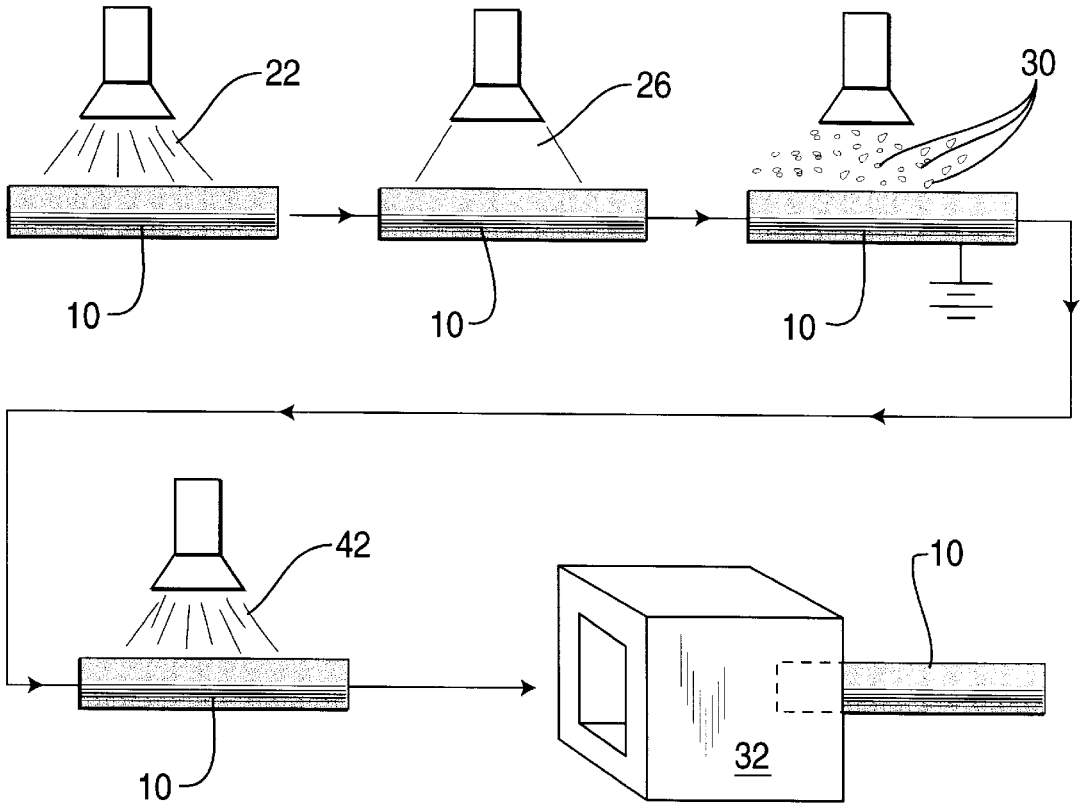
FIG. 3 is a schematic illustration of the method for making of the writing instrument of the present invention.
Figure 4:
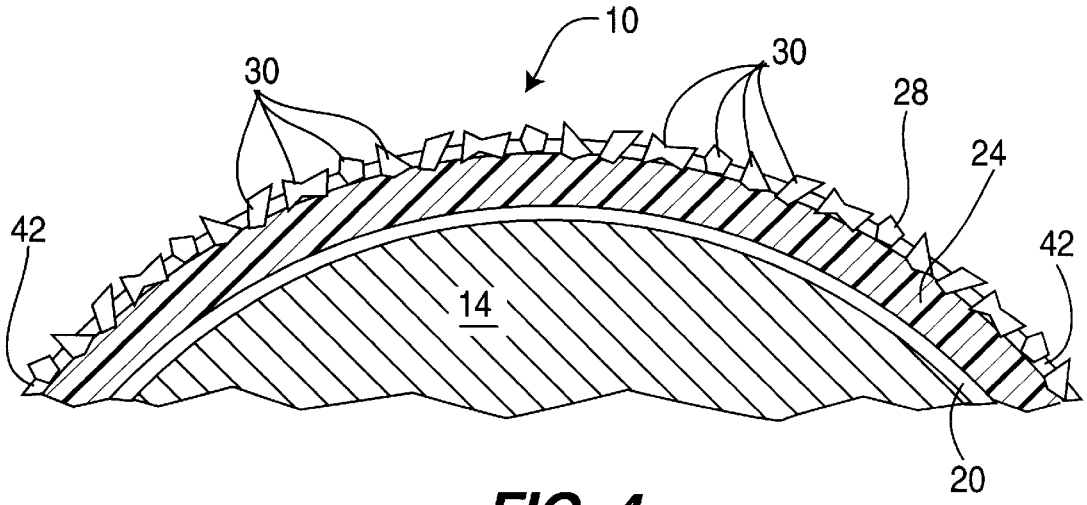
FIG. 4 is an exploded view of the surface area of the embodiment of the writing instrument shown in FIG. 2.

Once the glitter particles 30 are positioned as desired the writing instrument 12 is heated in order to cure the adhesive material 26. This heating is often performed within an oven 32. The writing tip 16 is shown as a pencil lead 40 in FIG. 2. FIG. 2 also shows the relative dimensions between the thicknesses of the first, second and third layer. Reference numeral 34 is the thickness of the first layer 20 of base colorant 22. Reference numeral 36 is the thickness of the second layer 24 of adhesive material 26. Reference numeral 38 refers to the thickness of the second layer 24 and third layer 28 added together. Thickness 38 added to thickness 34 is preferably approximately 0.425–0.45 millimeters. The basic initial size of the barrel 14 of the writing instruments 10 is 6.9 millimeters. Thus, if you add 6.9 millimeters to the thickness of all three coats applied twice through a diameter, the final dimension is achieved of 7.75–7.80 millimeters in diameter for the final product.

This final size is important since most pencil sharpeners are designed to sharpen pencils of this size. If a standard barrel such as a wooden barrel of the pencil were utilized and these three coatings were applied, the pencil would be too large for sharpening in such pencil sharpeners which is a distinct inconvenience in use thereof. Also it would be of a size larger than the normal diameter of a pencil and would have an uncomfortable feeling for most users. For this reason the initial size of the barrel 14 is reduced such that the final triple coated surface will be the conventional pencil diameter size. This process combined with the iridescent mylar glitter adhered in the unique manner with a base colorant provides an overall appearance and functionality which simultaneously will be both pleasing and utilitarian.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A method of making a writing instrument having a glitter-coated barrel comprising:

A. providing a writing instrument having a main body defining a barrel extending therearound with a writing tip positioned at one end thereof;

B. applying a base coat of colorant onto the barrel of the writing instrument;

C. applying a layer of adhesive material over at least a portion of the base coat of colorant on the barrel of the writing instrument;

D. depositing of glitter onto the layer of adhesive material on the barrel of the writing instrument; and E. curing of the adhesive material to affix the glitter and the adhesive material together with respect to the colorant coated barrel of the writing instrument, F. wherein the writing instrument is provided with a barrel having a diameter less than standard size by an amount equal to the thickness of the base colorant coat and the layer of adhesive material with deposited glitter after said curing thereof to provide a final barrel diameter approximately equal to the standard size to facilitate writing therewith and to allow conventional sharpening thereof.

2. A method of making a writing instrument having a glitter-coated barrel as defined in claim 1 wherein the writing instrument is a wooden pencil.

3. A method of making a writing instrument having a glitter-coated barrel as defined in claim 2 wherein the wooden pencil barrel is initially provided with a diameter of approximately 6.9 millimeters.

4. A method of making a writing instrument having a glitter-coated barrel as defined in claim 3 wherein the wooden pencil barrel is approximately 7.75 to 7.8 millimeters in diameter after the applying of the base coat of colorant and applying the adhesive material thereon with glitter and curing thereof.

5. A method of making a writing instrument having a glitter-coated barrel as defined in claim 1 wherein said applying a layer of adhesive material is performed by brushing thereof onto the barrel of the writing instrument.

6. A method of making a writing instrument having a glitter-coated barrel as defined in claim 1 wherein said applying a layer of adhesive material is performed by spraying thereof onto the barrel of the writing instrument.

7. A method of making a writing instrument having a glitter-coated barrel as defined in claim 1 wherein the main body and barrel are formed of plastic.

8. A method of making a writing instrument having a glitter-coated barrel as defined in claim 1 wherein the main body and barrel are formed of extruded plastic.

9. A method of making a writing instrument having a glitter-coated barrel as defined in claim 1 wherein said depositing glitter is performed with glitter having a particle size of less than 0.1 millimeters.

10. A method of making a writing instrument having a glitter-coated barrel as defined in claim 9 wherein said depositing of glitter is performed with glitter having a particle size of approximately 0.08 millimeters.

11. A method of making a writing instrument having a glitter-coated barrel as defined in claim 1 wherein said depositing of glitter is performed with glitter made of a mylar material.

12. A method of making a writing instrument having a glitter-coated barrel as defined in claim 11 wherein said depositing of glitter is performed with glitter made of an iridescent-colored mylar to impart a frosted appearance to the barrel.

13. A method of making a writing instrument having a glitter-coated barrel as defined in claim 1 wherein said applying of a base coat of colorant is performed with a paint.

14. A method of making a writing instrument having a glitter-coated barrel as defined in claim 1 wherein said applying of a base coat of colorant is performed with lacquer paint.

15. A method of making a writing instrument having a glitter-coated barrel as defined in claim 1 wherein said applying of a base coat of paint is performed with a paint having a color darker than the final coloration desired on the writing instrument barrel.

16. A method of making a writing instrument having a glitter-coated barrel as defined in claim 1 wherein said depositing of glitter onto the layer of adhesive material masks approximately 65% of the coloration of the base coat of colorant.

17. A method of making a writing instrument having a glitter-coated barrel as defined in claim 1 wherein the applying of a layer of adhesive material is performed with a resin-based adhesive material.

18. A method of making a writing instrument having a glitter-coated barrel as defined in claim 1 wherein the applying of a layer of adhesive material is performed with a plastic-based adhesive material.

19. A method of making a writing instrument having a glitter-coated barrel as defined in claim 1 wherein the applying of a layer of adhesive material is performed with an adhesive material including a polyvinyl acrylic glue.

20. A method of making a writing instrument having a glitter-coated barrel as defined in claim 1 wherein said depositing of glitter onto the layer of adhesive material is performed electrostatically.

21. A method of making a writing instrument having a glitter-coated barrel as defined in claim 1 wherein said depositing of glitter onto the layer of adhesive material is performed by electro-flocking the glitter onto the adhesive-coated writing instrument barrel.

22. A method of making a writing instrument having a glitter-coated barrel as defined in claim 21 wherein said electro-flocking includes the applying of approximately 10,000 volts to the barrel of the writing instrument to attract the glitter for depositing thereon and to facilitate adherence thereto.

23. A method of making a writing instrument having a glitter-coated barrel as defined in claim 1 wherein said applying a layer of adhesive material is performed over the entire area of the base coat of colorant on the barrel of the writing instrument.

24. A method of making a writing instrument having a glitter-coated barrel as defined in claim 1 wherein said depositing of glitter onto the layer of adhesive material is performed with only a single layer of glitter material.

25. A method of making a writing instrument having a glitter-coated barrel as defined in claim 1 wherein said depositing of glitter is performed with glitter material which is at least partially translucent.

26. A method of making a writing instrument having a glitter-coated barrel as defined in claim 25 wherein said depositing of glitter is performed with glitter material which is sufficiently translucent to allow approximately 35% of the base colorant coat to be externally visible after said curing of the adhesive material.

27. A method of making a writing instrument having a glitter-coated barrel as defined in claim 1 wherein said applying of-a base coat is performed with a primer-type colorant to facilitate adherence between the writing instrument barrel and the applied adhesive layer.

28. A method of making a writing instrument having a glitter-coated barrel as defined in claim 1 wherein said applying of adhesive material is performed with an adhesive material comprising a mixture of adhesive for wood and adhesive for plastic.

29. A method of making a writing instrument having a glitter-coated barrel as defined in claim 1 wherein said curing of the adhesive material includes heating thereof to facilitate final curing.

30. A method of making a writing instrument having a glitter-coated barrel as defined in claim 1 wherein depositing of glitter results in a layer of glitter having a thickness of only one glitter particle.

31. A method of making a writing instrument having a glitter-coated barrel as defined in claim 1 wherein said depositing of glitter is performed by spraying of glitter onto the adhesive material on the barrel of the writing instrument.

32. A method of making a writing-instrument having a glitter-coated barrel as defined in claim 1 further comprising applying of a cover coat of material which is at least partially translucent over the glitter-coated barrel to provide further adherence between the glitter and the barrel.

33. A method of making a writing instrument having a glitter-coated barrel as defined in claim 32 wherein said applying of a cover coat is performed with a transparent material.

34. A method of making a writing instrument having a glitter-coated barrel as defined in claim 33 wherein said applying of a cover coat is performed with a clear adhesive material to further enhance adherence between the glitter and the barrel without affecting the appearance thereof.

35. A method of making a writing instrument having a glitter-coated barrel as defined in claim 33 wherein said applying of a cover coat is performed with a clear lacquer paint.

36. A method of making a writing instrument having a glitter-coated barrel as defined in claim 33 wherein said applying of a cover coat is performed with a clear enamel paint.

37. A method of making a writing instrument having a glitter-coated barrel comprising:

A. providing a writing instrument having a main body defining a wooden barrel extending therearound with a writing tip positioned at one end thereof, the wooden barrel of the writing instrument having a diameter less than standard size by an amount equal to the thickness of the base colorant coat and the layer of adhesive material with deposited glitter after said curing thereof to provide a final barrel diameter approximately equal to the standard size to facilitate writing therewith and to allow conventional sharpening thereof;

B. applying a base coat of a colorant comprising a lacquer paint onto the barrel of the writing instrument;

C. applying a layer of adhesive material over at least a portion of the base coat of colorant on the barrel of the writing instrument, the adhesive material being a resin plastic-based glue;

D. depositing of mylar glitter of particle size less than 0.1 millimeters each and of a layer thickness of only one particle onto the layer of adhesive material on the barrel of the writing instrument by electro-flocking, the mylar glitter being at least partially translucent to allow approximately 35% of the colorant intensity to be viewable through the glitter filled layer of adhesive; and E. curing of the adhesive material to affix the glitter and the adhesive material together with respect to the colorant coated barrel of the writing instrument, the curing of the adhesive material including heating of the finally formed writing instrument to facilitate mutual adhesion between the barrel, the base paint, the adhesive material and the glitter layer.

38. A method of making a writing instrument having a glitter-coated barrel comprising:

A. providing a writing instrument having a main body defining a wooden barrel extending therearound with a writing tip positioned at one end thereof, the wooden barrel of the writing instrument having a diameter of approximately 6.9 millimeters in order to be less than standard size by an amount equal to the thickness of the base colorant coat and the layer of adhesive material with deposited glitter after said curing thereof to provide a final barrel diameter approximately equal to the standard size to facilitate writing therewith and to allow conventional sharpening thereof;

B. applying a base coat of a colorant comprising a lacquer paint onto the barrel of the writing instrument;

C. applying a layer of adhesive material by brushing thereof over the base coat of colorant on the barrel of the writing instrument, the adhesive material being a polyvinyl acrylic glue composition including wood adhesive and plastics adhesives;

D. depositing of an iridescent-colored mylar glitter of a particle size of approximately 0.08 millimeters each and of a layer thickness of only one particle onto the layer of adhesive material on the barrel of the writing instrument by electro-flocking, the mylar glitter being at least partially translucent to allow approximately 35% of the colorant intensity to be viewable through the glitter filled layer of adhesive; and E. curing of the adhesive material to affix the glitter and the adhesive material together with respect to the colorant coated barrel of the writing instrument with the base paint layer and the cured glitter covered adhesive layer being of approximately 0.425 to 0.45 millimeters in thickness to make a final writing instrument diameter of approximately 7.75 to 7.8 millimeters, the curing of the adhesive material including heating of the finally formed writing instrument to facilitate mutual adhesion between the barrel, the base paint, the adhesive material and the glitter layer.

39. A writing instrument having a glitter-coated barrel comprising:

A. a main body including a barrel extending therearound;

B. a writing tip extending outwardly from said barrel to facilitate marking with the writing instrument;

C. a first layer positioned extending over said barrel and comprising a base colorant in adherence with said barrel of said main body;

D. a second layer on said barrel comprising an adhesive material in adherence with said first layer of said base colorant and extending thereover; and E. a third layer of glitter material deposited onto said second layer of adhesive material to be in adherence with respect thereto;

F. wherein said barrel is of a diameter less than standard size by an amount equal to the thickness of said first layer of base colorant and said second layer of adhesive material and said third layer of glitter to form said barrel with an external diameter approximately equal to the standard size to facilitate writing therewith and to allow conventional sharpening thereof.

40. A writing instrument having a glitter-coated barrel as defined in claim 39 wherein said main body is wooden.

41. A writing instrument having a glitter-coated barrel as defined in claim 39 wherein said barrel of said main body is cylindrically shaped.

42. A writing instrument having a glitter-coated barrel comprising:

A. a main body including a barrel extending therearound;

B. a writing tip extending outwardly from said barrel to facilitate marking with the writing instrument;

C. a first layer positioned extending over said barrel and comprising a base colorant in adherence with said barrel of said main body;

D. a second layer on said barrel comprising an adhesive material in adherence with said first layer of said base colorant and extending thereover; and E. a third layer of glitter material deposited onto said second layer of adhesive material to be in adherence with respect thereto;

F. wherein said barrel of said main body have a diameter of approximately 6.9 millimeters prior to applying of said first layer of base colorant, said second layer of adhesive material and said third layer of glitter material thereover.

43. A writing instrument having a glitter-coated barrel as defined in claim 42 wherein said barrel of said main body has a diameter of approximately 7.75 to 7.8 millimeters after placement of said first layer of base colorant, said second layer of adhesive material and said third layer of glitter material thereover.

44. A writing instrument having a glitter-coated barrel as defined in claim 39 wherein said second layer of adhesive material is applied onto said barrel by hand brushing.

45. A writing instrument having a glitter-coated barrel as defined in claim 39 wherein said main body is made of an extruded plastic material.

46. A writing instrument having a glitter-coated barrel as defined in claim 39 wherein said glitter material has a particle size less than 0.1 millimeters.

47. A writing instrument having a glitter-coated barrel as defined in claim 46 wherein said glitter material has a particle size approximately equal to 0.08 millimeters.

48. A writing instrument having a glitter-coated barrel as defined in claim 39 wherein said glitter material is made of mylar.

49. A writing instrument having a glitter-coated barrel as defined in claim 39 wherein said glitter material is made of iridescent mylar.

50. A writing instrument having a glitter-coated barrel as defined in claim 39 wherein said first layer includes a base paint.

51. A writing instrument having a glitter-coated barrel as defined in claim 50 wherein said first layer of base paint has a coloration darker than the final desired coloration of the writing instrument.

52. A writing instrument having a glitter-coated barrel as defined in claim 39 wherein said first layer includes a base lacquer paint.

53. A writing instrument having a glitter-coated barrel as defined in claim 39 wherein said second layer of adhesive material and said third layer of glitter material mask approximately 65% of the intensity of the coloration of the first layer of base colorant.

54. A writing instrument having a glitter-coated barrel as defined in claim 39 wherein said second layer of adhesive material includes a resin-base glue.

55. A writing instrument having a glitter-coated barrel as defined in claim 39 wherein said second layer of adhesive material includes a polyvinyl acrylic glue.

56. A writing instrument having a glitter-coated barrel as defined in claim 39 wherein said third layer of glitter material is applied onto said second layer of adhesive material prior to curing thereof to facilitate adherence therebetween.

57. A writing instrument having a glitter-coated barrel as defined in claim 39 wherein said third layer of glitter material is applied to said second layer of adhesive material electrostatically.

58. A writing instrument having a glitter-coated barrel as defined in claim 39 wherein said third layer of glitter material-is applied to said second layer of adhesive material by electro-flocking.

59. A writing instrument having a glitter-coated barrel as defined in claim 39 wherein said third layer of glitter material is applied onto said second layer of adhesive to a thickness of one glitter particle.

60. A writing instrument having a glitter-coated barrel as defined in claim 39 wherein said third layer of glitter material is at least partially translucent to facilitate external visibility of said first layer of base colorant thereunder.

61. A writing instrument having a glitter-coated barrel as defined in claim 39 wherein said third layer of glitter material is at least partially translucent to facilitate transmission of approximately 35% of the colorant of said first base layer therethrough.

62. A writing instrument having a glitter-coated barrel as defined in claim 39 wherein said second layer of adhesive material and said third layer of glitter material are heated to facilitate curing of said adhesive material for firm adherence thereof with respect to said third layer of glitter material and with respect to said first layer of base colorant.

63. A writing instrument having a glitter-coated barrel as defined in claim 39 further comprising a fourth layer of translucent material deposited over the glitter-coated barrel to facilitate adherence therebetween.

64. A writing instrument having a glitter-coated barrel as defined in claim 63 wherein said fourth layer is transparent.

65. A writing instrument having a glitter-coated barrel as defined in claim 64 wherein said fourth layer is of a transparent adhesive material to enhance adherence between said third layer of glitter material.

66. A writing instrument having a glitter-coated barrel as defined in claim 64 wherein said fourth layer is of a clear lacquer paint material.

67. A writing instrument having a glitter-coated barrel as defined in claim 64 wherein said fourth layer is of a clear enamel paint material.

68. A writing instrument having a glitter-coated barrel comprising:

A. a main body including a barrel having a cylindrical shape extending therearound, said barrel being made of wood;

B. a writing tip extending outwardly from said barrel to facilitate marking with the writing instrument;

C. a first layer positioned extending over said barrel and comprising a base colorant in adherence with said barrel of said main body, said base colorant comprising lacquer paint;

D. a second layer on said barrel comprising an adhesive material of resin-based glue in adherence with said first layer of said base colorant and extending thereover; and E. a third layer of glitter material deposited onto said second layer of adhesive material to be in adherence with respect thereto and being of a thickness of one glitter particle, said third layer of glitter material being at least partially translucent to facilitate visibility therethrough of said first layer of base colorant thereunder, said third layer of glitter material being applied onto said second layer of adhesive material electrostatically prior to curing thereof to facilitate adherence therebetween, said glitter material being made of iridescent mylar, said barrel being of a diameter less than standard size by an amount equal to the thickness of said first layer of base colorant and said second layer of adhesive material and said third layer of glitter to form said barrel with an external diameter approximately equal to the standard size to facilitate writing therewith and to allow conventional sharpening thereof.

69. A writing instrument having a glitter-coated barrel comprising:

A. a main body including a barrel having a cylindrical shape extending therearound, said barrel being made of wood and being approximately 6.9 millimeters in diameter;

B. a writing tip extending outwardly from said barrel to facilitate marking with the writing instrument;

C. a first layer positioned extending over said barrel and comprising a base colorant in adherence with said barrel of said main body, said base colorant comprising lacquer paint, said base colorant includes alphanumeric and graphic depictions;

D. a second layer on said barrel comprising an adhesive material of polyvinyl acrylic glue in adherence with said first layer of said base colorant and extending thereover; and E. a third layer of glitter material including glitter particles of approximately 0.08 millimeters in size being deposited onto said second layer of adhesive material to be in adherence with respect thereto and being of a thickness of one of said glitter particles, said third layer of glitter material being at least partially translucent to facilitate visibility therethrough of said first layer of base colorant thereunder, said third layer of glitter material being applied onto said second layer of adhesive material electrostatically prior to curing thereof to facilitate adherence therebetween, said glitter material being made of iridescent mylar, said barrel being of a diameter less than standard size by an amount equal to the thickness of said first layer of base colorant and said second layer of adhesive material and said third layer of glitter to form said barrel with an external diameter approximately equal to the standard size to facilitate writing therewith and to allow conventional sharpening thereof, said first layer and said second layer and said third layer being of sufficient thickness to make the diameter of the finally formed writing instrument to be 7.75 to 7.8 millimeters in diameter.

70. A method of making a writing instrument having a glitter-coated barrel comprising:

A. providing a writing instrument having a main body defining a barrel extending therearound with a writing tip positioned at one end thereof; and B. applying a decorative surface onto the barrel of the writing instrument, said decorative surface including glitter particles;

C. wherein the writing instrument is provided with a barrel having a diameter less than standard size by an amount equal to the thickness of the decorative surface to provide a final barrel diameter approximately equal to the standard size to facilitate writing therewith and to allow conventional sharpening thereof.

71. A writing instrument having a glitter-coated barrel comprising:

A. a main body including a barrel extending therearound;

B. a writing tip extending outwardly from said barrel to facilitate marking with the writing instrument;

C. a decorative surface layer extending over said barrel and comprising glitter;

D. wherein said barrel is of a diameter less than standard size by an amount equal to the thickness of said decorative surface layer to form said barrel with an external diameter approximately equal to the standard size to facilitate writing therewith and to allow conventional sharpening thereof.

* * * * *